US005491312A

United States Patent [19]

Newman et al.

[11] Patent Number: 5,491,312

[45] Date of Patent: Feb. 13, 1996

[54] COMBINATION WASH/WIPER CONTACT SUBASSEMBLY

[75] Inventors: LaVerne R. Newman, Southfield; Dragan Bogovican, Sterling Heights, both of Mich.

[73] Assignee: United Technologies Automotive, Inc., Dearborn, Mich.

[21] Appl. No.: 308,241

[22] Filed: Sep. 19, 1994

[51] Int. Cl.[6] ..... H01H 9/00; H01H 1/36

[52] U.S. Cl. ..... 200/61.54; 200/11 G

[58] Field of Search ..... 200/4, 11 R, 11 D, 200/11 DA, 11 G, 11 J, 11 TW, 61.54

[56] References Cited

U.S. PATENT DOCUMENTS

| | | | |
|---|---|---|---|
| 3,518,389 | 6/1970 | Doering, Jr. et al. | 200/11 G X |
| 4,131,771 | 12/1978 | Erickson et al. | 200/11 DA |
| 4,387,279 | 6/1983 | Brevick | 200/61.54 |
| 4,390,757 | 6/1983 | Wiessner | 200/11 G |
| 4,451,715 | 5/1984 | Neese | 200/11 G |
| 4,625,084 | 11/1986 | Fowler et al. | 200/11 DA |
| 4,626,637 | 12/1986 | Olsson et al. | 200/11 G X |
| 4,849,585 | 7/1989 | Vidican et al. | 200/61.54 |

*Primary Examiner*—J. R. Scott
*Attorney, Agent, or Firm*—Harness, Dickey & Pierce

[57] ABSTRACT

A wash/wiper switch control assembly having an integrally formed wash/wiper contact member. The wash/wiper contact member includes a plurality of wiper contact arms which are integrally formed with a central body portion and a wash contact arm which is also integrally formed with the central body portion. The wash/wiper contact member is secured to an actuator member via conventional staking techniques. By manufacturing the wash/wiper contact member as a single component, the overall cost of manufacturing a wash/wiper switch control assembly is reduced. The complexity of manufacturing the wash/wiper contact member is also reduced while the reliability is improved since only a single component part need be secured to the actuator member versus prior art arrangements in which a wash contact and a separate wiper contact are secured to separate component parts of a wash/wiper switch control assembly.

7 Claims, 2 Drawing Sheets

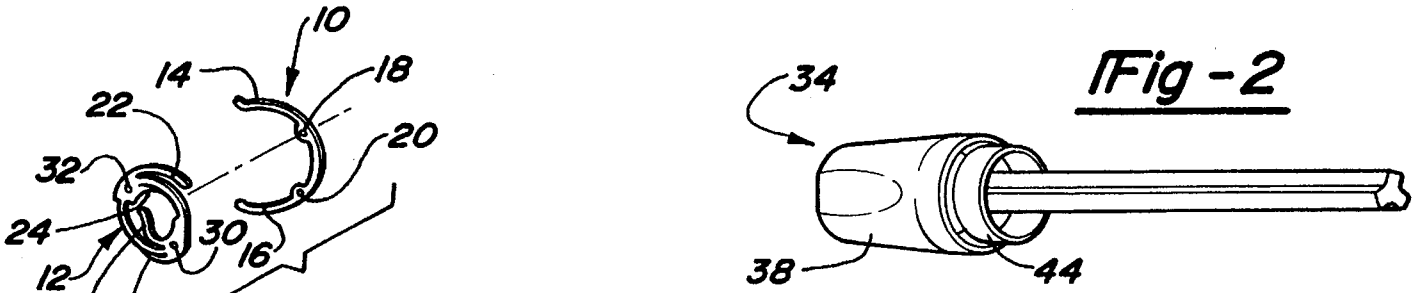
Fig-1
Fig-2
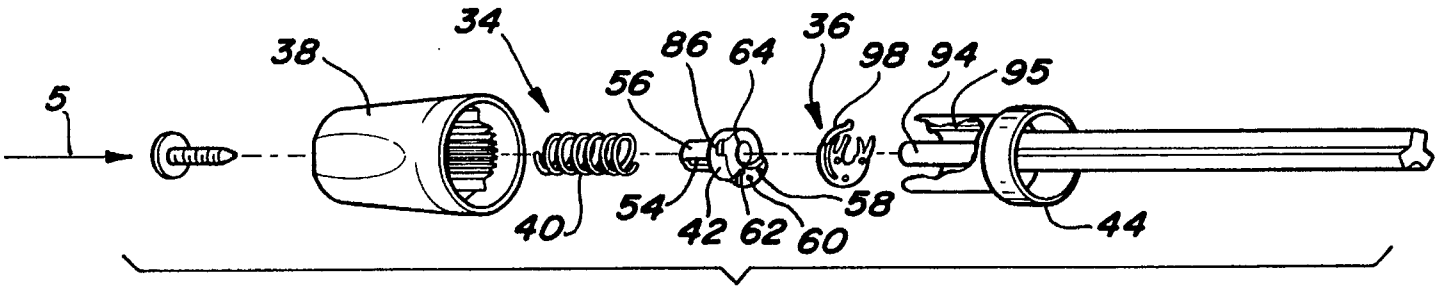
Fig-3
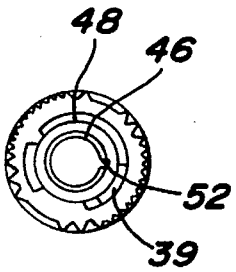
Fig-4
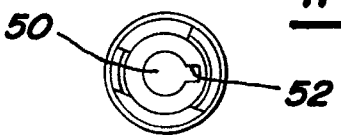
Fig-5

COMBINATION WASH/WIPER CONTACT SUBASSEMBLY

BACKGROUND OF THE INVENTION

1. Technical Field

This invention relates to wash/wiper switch control assemblies for vehicles such as automotive cars and trucks, and more particularly to a wash/wiper switch control assembly for controlling the on/off operation of a plurality of windshield wipers of the vehicle in addition to controlling the application of windshield washer solvent to the windshield of the vehicle.

2. Discussion

Many present day automobiles, trucks and other motor vehicles include some form of wash/wiper switch control assembly. The wash/wiper switch control assembly typically performs two functions: controlling the on/off operation of a plurality of windshield wipers of the vehicle as well as the application of windshield washer solvent to the windshield of the vehicle. Many such switch control assemblies further allow intermittent wiper operation and operator control over the frequency of wiper operation. This allows the speed of the windshield wipers to be increased or decreased within a predetermined range by the operator rotating a cover member of the switch assembly, to thereby allow the speed of the wipers to be tailored to the environmental conditions such as the severity of a rain storm which the vehicle is passing through.

Such prior developed wash/wiper switch control assemblies typically include a cover member which is graspable by the operator, a spring at least partially disposed within the cover member, an actuator member which is at least partially disposed within the cover member in such a manner that rotation of the cover member causes a corresponding rotation of the actuator member, a wiper contact member physically secured to the actuator member and a wash contact member which is physically secured to the interior of the cover member. The wiper contact member operates to selectively complete a circuit secured to a lever member of the assembly as the cover member is rotated, which controls the speed of operation of the wipers as the cover member is rotated by the operator. As an example, rotating the cover member counter-clockwise might cause the intermittency of the wiper operation to be reduced (i.e., the wipers operate less frequently) while rotating the cover member clockwise might increase the frequency of operation of the wipers. The wash contact member, being a separate component part, typically is disposed such that when the cover member is pushed in by the operator towards the lever member against the biasing force provided by the spring, the wash contact member engages a portion of a circuit board mounted to the lever member. This activates a windshield washer solvent pump to cause windshield washer solvent to be applied to the windshield while the cover member is held in a depressed position.

While the above described wash/wiper switch control assembly has proven to be extremely useful in controlling a plurality of independent functions of the wash/wiper components of the vehicle, the wiper contact member and the wash contact member, being separate component parts which must be separately secured to the actuator and the cover member in at least two independent steps. This has somewhat increased the cost and complicated the manufacture of such wash/wiper switch control assemblies. Since wash/wiper switch control assemblies are used in large volumes, the added cost of requiring two staking operations to independently secure the wiper contact and the wash contact member to the actuator member and cover member, as well as the added complexity to the manufacturing of this assembly because of these two required steps, has represented a sizeable manufacturing component cost.

Accordingly, it would be highly desirable if the wiper contact and the wash contact could be integrated in a manner such that a single component part is formed from these two individual component parts. A single wash/wiper contact member would significantly simplify the overall manufacture of the wash/wiper switch control assembly. Such a single component would also save costs by eliminating one of two manufacturing steps presently required in independently staking the wash contact member and the wiper contact member to their respective components. Still further, reliability could be increased if the wash contact member and wiper contact member were manufactured as a single, integrally formed component which could be secured as a single piece component to the actuator member of such a switch control assembly. Such a single piece wash/wiper contact member would improve reliability by eliminating the positional variations between the wash contact member and the wiper contact member when these components are independently secured as two separate component parts to the cover member and the actuator member.

It is therefore a principal object of the present invention to provide an integrally formed wash/wiper contact member for use in a wash/wiper switch control assembly, where the wash/wiper contact member can be secured as a single component part to the actuator member of the assembly.

SUMMARY OF THE INVENTION

The above and other objects are provided by an integrally formed wash/wiper contact member in accordance with a preferred embodiment of the present invention. The wash/wiper contact member includes a central body portion having a plurality of wiper contact arms protruding therefrom and formed integrally with the central body portion, and a wash contact arm formed integrally with the central body portion. The wash/wiper contact member is securable as a single component part to the actuator member. The central body portion includes a plurality of apertures which accept a corresponding plurality of bosses on the actuator to allow the wash/wiper contact member to be precisely positioned on the actuator member and subsequently staked or otherwise secured to the actuator member via conventional staking techniques. Since the wash/wiper contact member is a single, integrally formed component part, the manufacture of the overall switch control assembly is simplified since the entire wash/wiper contact member can be secured in a single step to the actuator. As will be appreciated, with previously developed wash/wiper switch control assemblies, the wash contact member and wiper contact member were separate component parts which were secured in two steps independently of each other to the cover member and the actuator member. By manufacturing the wash/wiper contact member as a single, integrally formed component, the process and cost of manufacturing the overall switch control assembly is reduced and reliability improved.

BRIEF DESCRIPTION OF THE DRAWINGS

The various advantages of the present invention will become apparent to one skilled in the art by reading the following specification and subjoined claims and by referencing the following drawings in which:

FIG. 1 is an exploded perspective view of a prior art wash contact member and wiper contact member;

FIG. 2 is a perspective view of a switch control assembly incorporating the integrally formed wash/wiper contact member of the present invention;

FIG. 3 is an exploded perspective view of the wash/wiper switch control assembly of FIG. 2;

FIG. 4 is a plan view of the interior of the cover member of the switch control assembly of FIG. 3;

FIG. 5 is a plan view of the opposite end of the cover member shown in FIG. 3, taken in accordance with directional line 5 in FIG. 3;

DETAILED DESCRIPTION OF THE PREFERRED EMBODIMENTS

Figure 6:
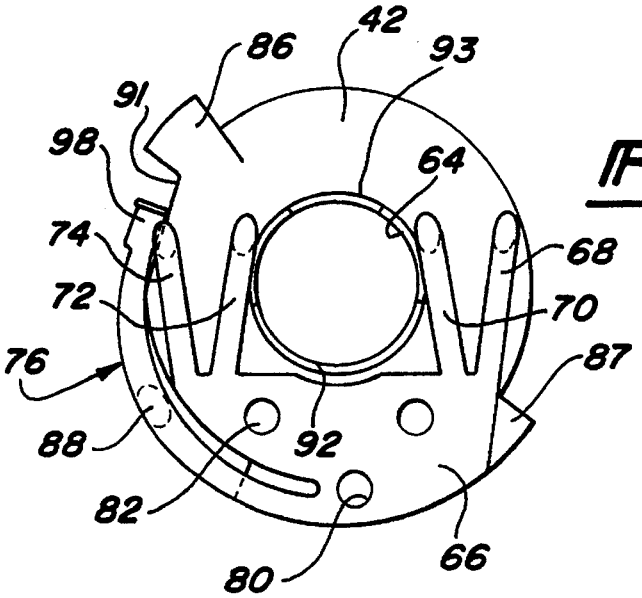
FIG. 6 is a plan view of a preferred embodiment of the integrally formed wash/wiper contact member of the present invention.

Referring initially to FIG. 1, there is shown a prior art wash contact member 10 and wiper contact member 12. The wash contact member 10 includes a pair of arm members 14 and 16 and a plurality of apertures 18 and 20 which allow the wash contact member 10 to be secured to the cover member of a wash/wiper switch control assembly. The wiper contact member 12 also includes arm members 22, 24, 26 and 28, in addition to a plurality of apertures 30 and 32. The apertures 30 and 32 allow the wiper contact member 12 to be secured to an actuator member of a switch control assembly. Thus, two separate manufacturing steps are required to secure these components 10 and 12 to their associated component parts within a conventional switch control assembly. The requirement for securing each separately, as will be appreciated, increases the cost of manufacture of the overall switch control assembly as well as increasing its complexity. Reliability can also be compromised because the positioning of the wash contact member on its associated component part (i.e., typically a operator rotatable cover member) needs to be relatively precise to enable proper contact to be made between the contact arms 14 and 16 when the arms 14 and 16 are urged against appropriate traces on a printed circuit board assembly to selectively activate a washer solvent pump. Thus, it would be highly desirable to incorporate both the wash contact member 10 and the wiper contact member 12 into a single component part which can be secured to a single associated component of the switch control assembly, such as an actuator member thereof, in a single manufacturing step. Such a wash/wiper contact member would reduce the cost of manufacture of the overall switch control assembly, simplify manufacture and improve the overall reliability of the switch control assembly.

Referring now to FIGS. 2 and 3, there is shown a wash/wiper switch control assembly 34 incorporating an integrally formed wash/wiper contact member 36 (FIG. 3) in accordance with a preferred embodiment of the present invention. The wash/wiper switch control assembly 34 generally comprises an operator graspable and rotatable cover member 38, a spring 40, an actuator member 42, the wash/wiper contact member 36 and a lever member 44. With reference to FIGS. 3 and 4, the spring 40 fits within the cover member 38 in conventional fashion within a plurality of generally circular, raised portions 46 and 48 (FIG. 4) which help to keep the spring 40 centered within the cover member 38 during assembly and during operation of the switch control assembly 34. With brief reference to FIG. 5, the cover member 38 includes a central opening 50 having a key 52.

With further reference to FIG. 3, the actuator member 42 includes a raised rib 54 on a shaft portion 56 thereof which is adapted to fit within the key 52. In this manner, rotation of the cover member 38 by an operator causes a corresponding rotational movement of the actuator member 42. The actuator member 42 also typically includes a plurality of boss portions 58, 60 and 62. A bore 64 extends through the entire length of the actuator member 42.

With further reference specifically to FIGS. 3 and 6, the preferred embodiment of the wash/wiper contact member 36 includes a central body portion 66, a plurality of wiper contact arms 68, 70, 72 and 74 integrally formed with the central body portion 66 and extending outwardly away from a plane formed by the central body portion 66. It should be noted that the wiper contact arms 68–74 are also straight, that is, they extend generally longitudinally from the central body portion 66. From FIG. 1, it will be noted that the wiper contact arms 22–28 of the prior art wiper contact member 12 extend along curved paths. The generally straight wiper contact arms 68–74 further help to improve reliability of operation and simplify manufacture of the wash/wiper contact member 36.

With further reference specifically to FIG. 6, the wash/wiper contact member 36 includes a wash contact arm 76 which is integrally formed with the central body portion 66. The central body portion 66 includes a plurality of openings 78, 80 and 82, as well as a central opening 84. The actuator member 42 also can be seen to include a first rotation stop 86 and a second rotation stop 87 integrally formed thereon. The first and second rotation stop 86, 87 limit the degree of rotation of the actuator member 42 when the actuator member 42 is placed over a shaft 94 of the lever member by alternately abutting a raised rib 95 as the actuator member 42 is turned clockwise and counter-clockwise. The actuator member 42 is therefore essentially identical to prior art actuator members. From the drawing of FIG. 6, the wiper contact arms 68–74 extend toward the viewer, away from the central body portion 66, while the wash contact arm 76 is formed so as to extend away from the viewer beginning at approximately area 88 of the length thereof.

Figure 8:
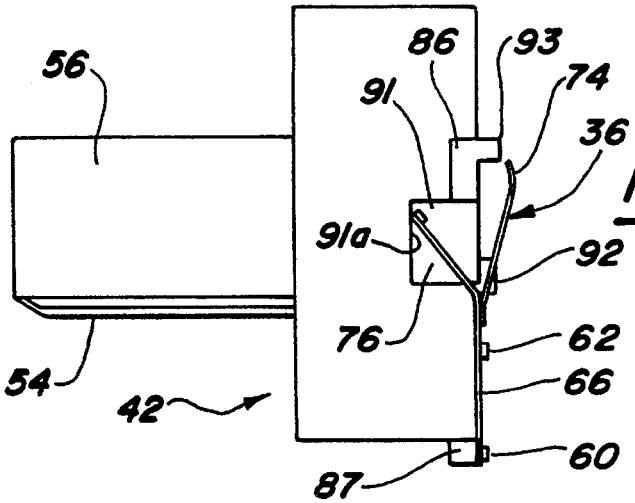
FIG. 8 is a side view of the actuator with the wash/wiper contact member secured thereto.

With brief reference to FIGS. 6 and 8, the actuator 36 can be seen to include a notched portion 91 which limits the rearward (i.e., leftward in FIG. 8) movement of the wash contact arm 76. Preferably, the wash/wiper contact member 36 contact arm is manufactured such that when installed the arm 76 is abutting an edge 91*a* of the notch 91. FIG. 8 also shows a radius boss 92 for setting a gap between the wash/wiper member 36 and the printed circuit assembly 90. Also shown is a radius boss 93 that abuts the printed circuit assembly 90 and allows the wash/wiper member 36 to be secured to the actuator member 42.

Figure 7:
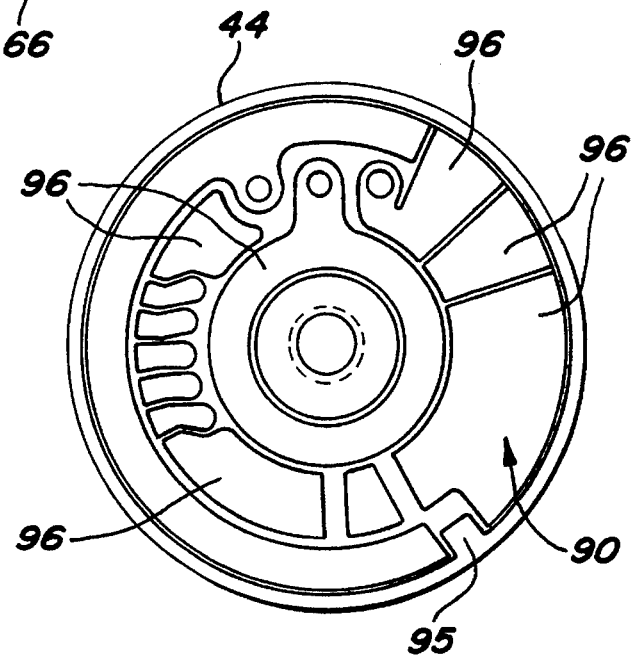
FIG. 7 is a plan view of the conductive traces of a printed circuit assembly used in connection with the wash/wiper contact member of the present invention.

With reference now to FIGS. 3 and 7, the lever member 44 (FIG. 3) includes disposed thereon a printed circuit assembly 90 (FIG. 7). The printed circuit assembly 90 has an opening 92 to enable it to be placed over the shaft 94 (FIG. 3) of the lever member 44 in conventional fashion. The printed circuit assembly 90 shown in FIG. 7, includes a plurality of electrically conductive traces 96 which are arranged to make contact with the wiper contact arms 68–74 when the switch control assembly 34 is assembled. It will be appreciated that the layout of the conductive traces of the printed circuit assembly 90, shown in FIG. 5, is virtually identical to prior art printed circuit assemblies used for this purpose. As the cover member 38 is used to rotate the actuator member 42, the wiper contact arms 68–74 selectively contact the various traces 96 which causes various circuits of the printed circuit assembly 90 to be energized, thus causing on/off operation of a plurality of windshield wipers of the vehicle as well as controlling the intermittency of operation of the windshield wipers.

With further reference to FIGS. 3 and 6–7, when the operator pushes in on the cover member 38, a raised shoulder portion 39 (FIG. 4) of the cover member 38 abuttingly engages portion 98 (FIG. 6) of the wash contact arm 76. This causes the wash contact arm 76 to be pushed inwardly towards the printed circuit assembly 90 and to make contact with a predetermined one of the conductive traces 96 while the cover member 38 is held inwardly by the operator. Since the cover member 38 is keyed to the actuator member 42, the position of the raised shoulder portion 39 is maintained over portion 98 of the wiper contact arm 76 regardless of the rotational position of the cover member 38.

The wash/wiper contact member 36 of the present invention may be manufactured from a wide variety of electrically conductive materials, but is preferably manufactured from copper alloy. By manufacturing the wash/wiper contact member 36 as a single component, the member 36 can be secured to the bosses 58–62 of the actuator member 42 by conventional staking techniques in a single staking step. Thus, two independent staking operations on separate component parts of the switch control assembly 34 are not required. By manufacturing the wash/wiper contact member 36 as a single component part, the reliability of the overall switch control assembly 34 is increased since the positional variation between the separate wash contact member 10 and wiper contact member 12 (FIG. 1) of prior art designs is eliminated. As will also be appreciated, the overall cost of manufacturing the switch control assembly 34 is reduced by using a single component wash/wiper contact member 36.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A combination wash/wiper contact member for a multifunction wash/wiper switch assembly for a vehicle for controlling at least one wiper blade associated with a windshield of the vehicle and for controlling the application of windshield washer solvent from the switch assembly, said wash/wiper contact member comprising:

a central body portion;

a plurality of wiper contact arms protruding outwardly from said central body portion, each arm having a first end and a second end, said first end being integrally formed with said central body portion, said second end being formed for selective contact with a first electrically conductive surface, each of said plurality of wiper contact arms extending away from a plane formed by said central body portion;

a wash contact arm integrally formed with said central body portion and protruding outwardly away from said plane in a direction opposite that of said plurality of wiper contact arms for selective contact with a second conductive surface co-planar with said first conductive surface; and said wash/wiper contact member being securable as a single component to an actuator member of said switch assembly.

2. The wash/wiper contact member of claim 1, wherein said wiper contact arms extend generally linearly from said central body portion.

3. The wash/wiper contact member of claim 1, wherein said central body portion includes a plurality of apertures for allowing said central body portion to be staked to said actuator member.

4. A wash/wiper switch control assembly for a vehicle for controlling a plurality of windshield wipers of the vehicle and for controlling the application of windshield washer solvent to a windshield of a vehicle, said switch assembly comprising:

a cover member;

a spring at least partially disposed within said cover member;

an actuator member operably associated with said spring so as to be biased by said spring;

a lever member operably associated with said actuator member so as to allow said actuator member to rotate within a portion of said lever member;

a wash/wiper contact member comprising:

a central body portion;

a plurality of wiper contact arms protruding outwardly from said central body portion, each arm having a first end and a second end, said first end being integrally formed with said central body portion, said second end being formed for selective contact with a first electrically conductive surface, each of said plurality of wiper contact arms extending away from a plane formed by said central body portion;

a wash contact arm integrally formed with said central body portion and protruding outwardly away from said plane in a direction opposite that of said plurality of wiper contact arms for selective contact with a second conductive surface co-planar with said first conductive surface; and said wash/wiper contact member being securable as a single piece component to said actuator member and positioned within said portion of said lever member so as to rotate in accordance with said actuator member.

5. The wash/wiper switch assembly of claim 4, wherein said wiper contact arms of said wash/wiper contact member extend generally linearly away from a plane formed by said central body portion.

6. The wash/wiper switch assembly of claim 4, wherein said wiper contact arms extend linearly in a general longitudinal path away from said central body portion.

7. The wash/wiper switch assembly of claim 4, wherein said central body portion of said wash/wiper contact member includes a plurality of apertures;

wherein said actuator member includes a plurality of boss portions positioned to be in alignment with said apertures; and wherein said wash/wiper contact member is secured to said actuator member after said wash/wiper contact member is placed against said actuator member such that said boss portions extend through said plurality of apertures in said central body portion.

* * * * *